United States Patent [19]

Lawrence

[11] 4,421,204

[45] Dec. 20, 1983

[54] FIRE RESCUE SYSTEM

[75] Inventor: Bernard L. Lawrence, 901 Yuma, Independence, Mo. 64056

[73] Assignee: La Donna Lawrence, Independence, Mo.

[21] Appl. No.: 257,640

[22] Filed: Apr. 27, 1981

[51] Int. Cl.[3] ..... A62B 1/02

[52] U.S. Cl. ..... 182/50; 182/51; 182/142; 244/31

[58] Field of Search ..... 182/12–14, 182/142, 141, 50, 51, 40, 82; 169/53, 52; 244/33, 31, 137 R, 137 P

[56] References Cited

U.S. PATENT DOCUMENTS

| | | | |
|---|---|---|---|
| 480,759 | 8/1892 | Baker | 182/142 |
| 1,027,724 | 5/1912 | Haney | 182/142 |
| 1,396,489 | 11/1921 | Williams | 244/33 |
| 1,609,762 | 12/1926 | Morgan | 169/53 |
| 2,492,800 | 12/1949 | Isom | 244/31 |
| 3,273,651 | 9/1966 | Andrews | 169/53 |
| 3,277,724 | 10/1966 | Lundeberg | 244/31 |
| 3,393,769 | 7/1968 | Springer | 182/82 |
| 3,931,868 | 1/1976 | Smith | 182/82 |
| 3,972,386 | 8/1976 | Hayslip | 182/50 |
| 4,195,694 | 4/1980 | Gizzarelli | 169/53 |

FOREIGN PATENT DOCUMENTS

| | | | |
|---|---|---|---|
| 733801 | 3/1943 | Fed. Rep. of Germany | 244/33 |

*Primary Examiner*—Reinaldo P. Machado
*Attorney, Agent, or Firm*—Kokjer, Kircher, Bradley, Wharton, Bowman & Johnson

[57] ABSTRACT

This invention relates to a method and equipment for fire fighting and rescue in conjunction with high rise buildings. A balloon having a capacity for lifting objects is coupled with a gondola for transporting people and equipment to and from an elevated location. The balloon is movable vertically relative to the gondola so that the balloon may be positioned out of the way once the gondola reaches a desired working height. Also, the balloon is compartmentalized so that, if one or more compartments become deflated, the remaining compartments will have sufficient lifting capacity to hold the gondola and its cargo. Elevator means on the gondola is provided for raising and lowering people and equipment to and from the ground so that the gondola and balloon need not be raised and lowered on a continual basis. A water gun and harpoon gun disposed on the gondola along with other necessary fire fighting equipment provide for complete fire fighting and rescue from the elevated location.

6 Claims, 7 Drawing Figures

FIRE RESCUE SYSTEM

This invention relates generally to fire fighting and rescue equipment and, more particularly, to a method and apparatus particularly adapted for use in fire fighting and rescue work in conjunction with high rise buildings.

The problem of safely removing people from burning or damaged buildings is of utmost concern wherever these structures are found. Building codes universally provide for the inclusion of fire escapes and other safety features in any type of building with more than a few stories. Manifestly, as the height of the building increases, the difficulty of rescue and fire fighting increases even more. While many building codes now require the use of sprinkler systems in high rise buildings to extinguish the fire and smoke alarms to warn occupants of the danger, little attention has been given to improved devices for actually removing people from building heights.

When buildings are limited in height to five stores or less, fire escapes are generally adequate to permit escape under most circumstances. Extension ladders can also be utilized up to a height of four or five stores. In nearly every city around the world, however, many buildings are found ranging from 40 stories in height to over 100 stories. Rescue and fire fighting in buildings of these heights presents unique problems of a magnitude not elsewhere encountered. Little progress has been made in recent years to improve fire fighting and rescue work in such high rise buildings.

Prior attempts to provide rescue and fire fighting equipment are exemplified by the devices shown in U.S. Pat. Nos. 3,931,868 and 1,609,762. While both of these prior art devices contemplate some type of rescue equipment being elevated to a multi-story building, neither device has found practical acceptance. In the case of the first-mentioned patent, the resuce gondola is supported by a helicopter making it extremely expensive and limiting its maneuverability. The other patented device again is highly impractical because of its limited maneuverability and high cost. A major problem with the dirigible disclosed in U.S. Pat. No. 1,609,762 is that it holds the water tank in fixed relationship to the dirigible thus making it virtually impossible to get close to intermediate stories of tall buildings for rescue work.

Another known aerial device is that disclosed in U.S. Pat. No. 1,396,489. While the device disclosed in this patent is not intended for use in fire or resuce work, such a use could possibly be made, although only to a very limited extent. With this device, the spacial relationship between the gondola and the supporting balloon is fixed thus again causing problems of maneuverability and also subjecting the balloon to the danger of destruction from the heat of a burning building.

It is, therefore, a primary object of the present invention to provide a fire fighting and rescue system wherein a lighter-than-air balloon is utilized to support the fire fighting and rescue equipment.

Another object of the invention is to provide a fire rescue system of the type set forth in the preceding object wherein the balloon can be raised and lowered relative to the equipment to thereby increase the maneuverability and reduce the danger of the balloon becoming damaged by the heat of the fire.

An important aim of this invention is also to provide a compartmentalized balloon particularly adapted for use in fire fighting and rescue work wherein the balloon is capable of supporting a load after some of the compartments become deflated.

Another objective of this invention is to provide a system meeting the objects and aims heretofore set forth and also providing for the raising and lowering of people and equipment from the gondola to the ground so as not to require the gondola to be repeatedly raised and lowered.

It is also one of the aims of my invention to provide a fire fighting and rescue system employing a balloon and gondola which can be completely stored and transported on a flatbed trailer.

As a corollary to the preceding aim, an objective of the invention is to provide such a system wherein the flatbed trailer may be utilized to anchor the gondola and serve as a command post for the overall system.

A very important object of the invention is to provide a fire fighting and rescue system for use with high rise buildings which is designed to provide greater maneuverability than prior art systems employing helicopters, balloons and dirigibles.

Still another objective of the invention is to provide a fire fighting and rescue system for use in conjunction with high rise buildings which utilizes a balloon to support the equipment rather than a helicopter, thereby eliminating the problem of helicopter down drafts on the equipment.

Still another object of my invention is to provide a system of the type described in the foregoing aims and objects which is capable of carrying fire fighting equipment to any desired height of a high rise building.

Other objects of the invention will be made clear or become apparent from the following description and claims when read in light of the accompanying drawing, wherein:

Figures 1, 2:
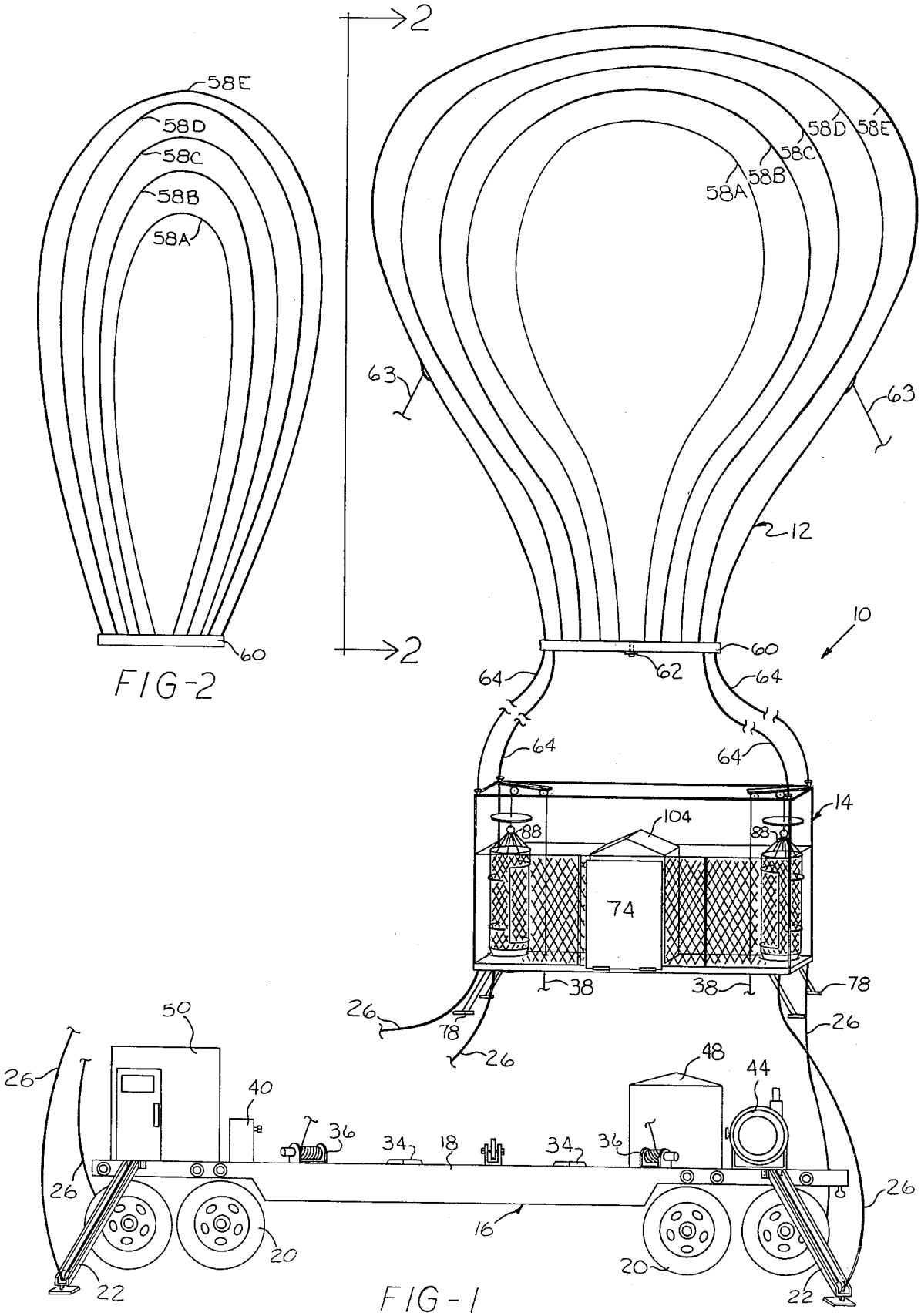
FIG. 1 is an elevational view of the fire fighting and rescue equipment of the present invention, some of the equipment having been omitted from the gondola for clarity.
FIG. 2 is a partial elevational view looking in the direction of line 2—2 of FIG. 1.
Figure 4:
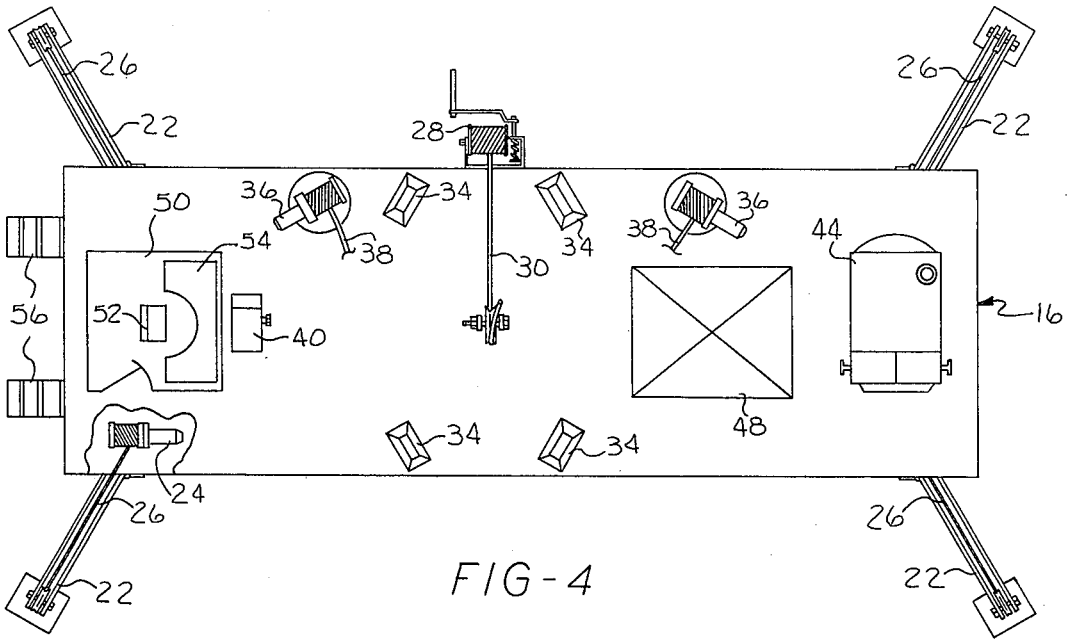
FIG. 4 is a top plan view of the supporting trailer when looking in the direction of line 4—4 of FIG. 3.

Referring initially to FIG. 1, the fire and rescue equipment of the present invention is designated generally by the numeral 10. Equipment 10 includes a balloon 12, a gondola 14, and a support trailer 16, all of which will be described in greater detail hereinafter.

Figure 3:
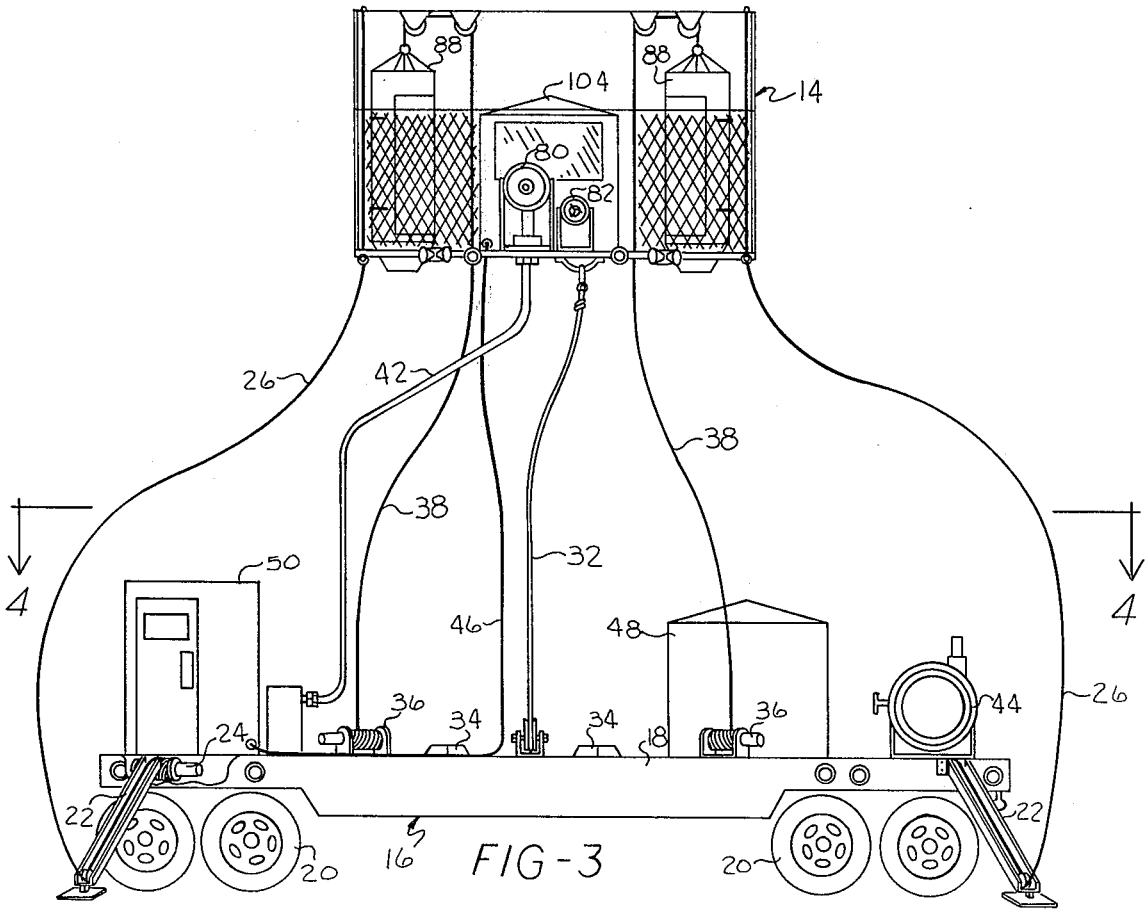
FIG. 3 is another elevational view showing the gondola and supporting trailer in greater detail.

Details of the support trailer 16 are best illustrated in FIG. 3 wherein it is seen that the trailer includes a bed 18 supported by wheels 20 for over-the road travel. Bed 18 is provided with outriggers 22 at each of the four corners of the trailer for stabilization. Each outrigger is hinged to the side of bed 18 for movement from a storage position to an extended position. It is to be understood that the area beneath bed 18, while not shown in detail, will normally be compartmentalized and serve as storage capacity for helium, oxygen and water tanks as well as other equipment.

Disposed at each corner of trailer 16 beneath bed 18 and immediately adjacent each outrigger 22 is a power winch 24. Each winch is coupled with a cable 26 which in turn is coupled with gondola 14 for purposes to be made clear hereinafter.

A hand operated winch 28 is mounted at one side of trailer 16 and is provided with a rope 30 to which a tether line 32 is releasably coupled. Tether line 32 is in turn coupled with gondola 14. Pads 34, which extend upwardly from bed 18, provide a seat on which the gondola may rest when it is lowered onto the trailer.

Two additional power winches 36 are mounted on bed 18 and each has a line 38 coupled therewith and extending upwardly to the gondola for purposes to be made clear hereinafter. A pump 40 mounted in the fore section of trailer 16 is utilized to pump water from a tank or hydrant to gondola 14. To this end, a water line 42 extends from the pump upwardly to the gondola.

An electrical generator 44 is mounted at the aft end of trailer 16 to provide electrical power for gondola 14. Thus, an electrical line 46 which is coupled with generator 44 extends from the trailer to the gondola. An enclosure 48 is also provided on trailer 16 for housing balloon 12 once the latter has been deflated. A second enclosure 50 at the opposite end of the trailer serves as a control station. This second enclosure includes a captain's chair 52 and a control panel 54 for controlling and monitoring all aspects of the system. Two sets of steps 56 which can be moved in and out of position are provided at the fore end of trailer 16 so as to facilitate travel to and from bed 18.

Details of construction of balloon 12 will now be described. The balloon is comprised of five independent inflatable compartments designated 58A–58E. These compartments are disposed one within the other and each compartment is of a generally flattened eliptical configuration with a width in one direction which is at least twice the breadth in the intersecting direction. A restraining collar 60 is coupled with each of the compartments 58A–58E at their base. Collar 60 maintains the compartments 58A–58E in a desired pre-determined spacial relationship. Appropriate valving 62 is provided for controlling the flow of gas into compartment 58A. It is to be understood that identical valving is provided for each of compartments 58B–58E although this additional valving has been omitted from the drawing in the interest of simplicity and clarity. Coupled with retaining collar 60 are four cables 64 which extend downwardly and are coupled with gondola 14 which will be more fully explained hereinafter. Tether lines 63 extend away from the outermost balloon section 58E to help stabilize the balloon.

With particular reference to FIG. 1 and FIGS. 5–7, details of gondola 14 will now be described. A generally box-like rigid framework 66 is partially enclosed by a fence 68 and supports a floor 70. Fence 68 is provided with a sliding gate 72 so as to access a gangplank 74 which is hingedly mounted at one side of framework 66. Stairs 76 lead downwardly from gate 72. Legs 78 extend downwardly from floor 70 to support the gondola when it is resting on bed 18. Mounted inside of fence 68 on floor 70 is a water gun 80 which is coupled with water line 42. Water gun 80 includes manual controls **80*a* and 80*b*** for adjusting the orientation of the gun about both vertical and horizontal axes.

Also disposed inside of fence 68 and mounted on floor 70 is a powered harpoon gun 82 for delivering a grappling hook 84 to a remote location. Controls **82*a* and 82*b* provide means for adjusting the orientation of gun 82** about both horizontal and vertical axes.

Figure 5:
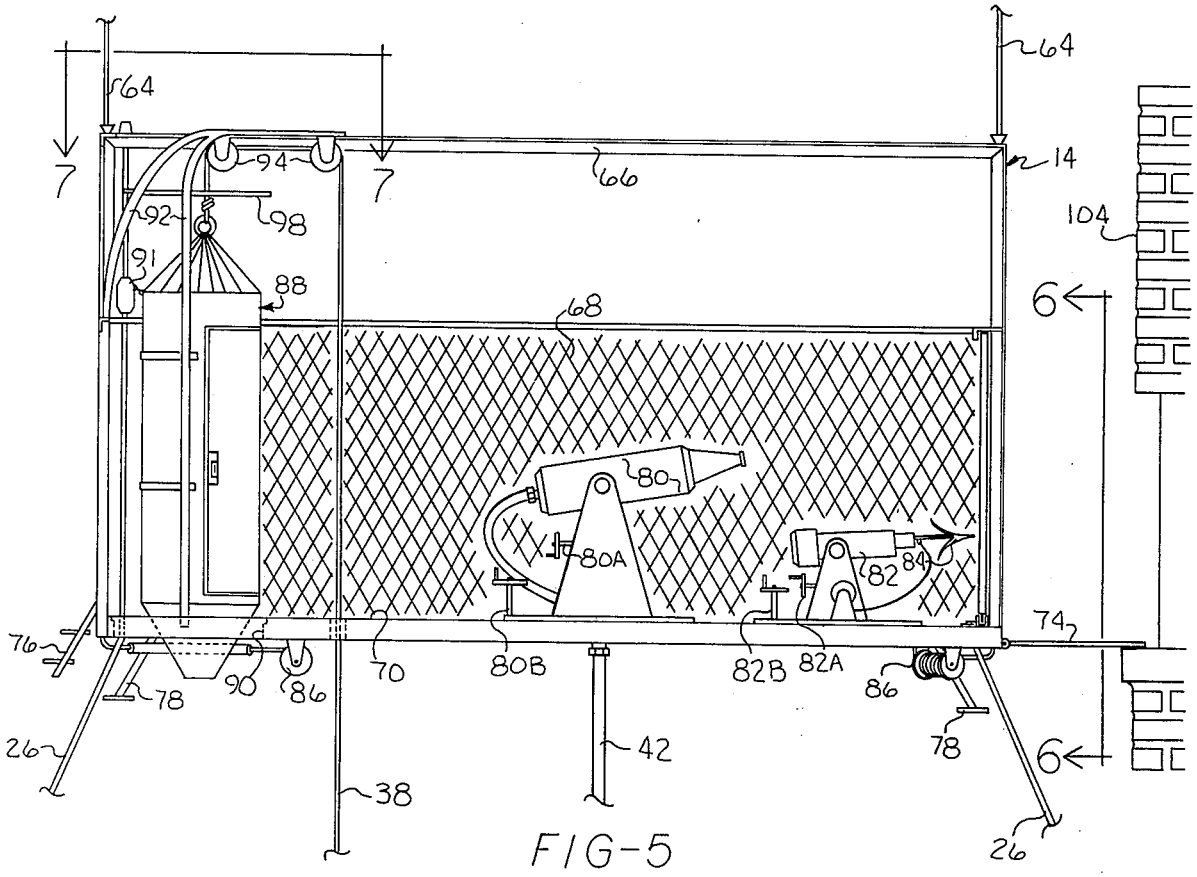
FIG. 5 is an enlarged detail elevational view of the gondola.
Figure 7:
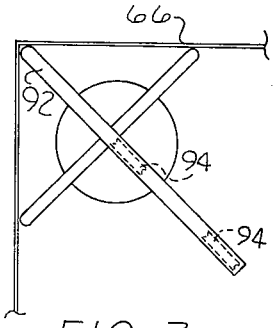
FIG. 7 is a fragmentary top plan view looking in the direction of line 7—7 of FIG. 5.
Figure 6:
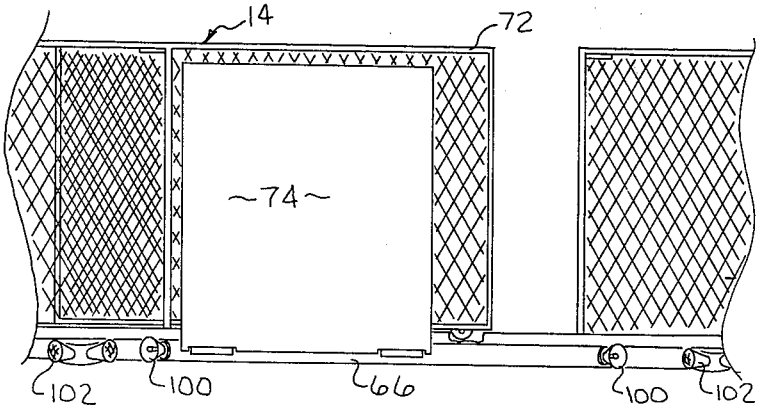
FIG. 6 is an end elevational view looking in the direction of line 6—6 of FIG. 5.

Disposed on the underside of floor 70 are four power winches 86, two of which are visible in FIG. 5. Each of the winches 86 is coupled with one of the cables 64 for controlling vertical movement of balloon 12. As best shown in FIG. 1, gondola 14 is also outfitted with two movable baskets 88. For the sake of clarity, only one basket 88 is shown in FIG. 5 and this basket will be described in greater detail. It is to be understood that the other basket and supporting equipment is identical in construction. An opening 90 in floor 70 accommodates movement of the basket in and out of gondola 14. A flexible coupling 91 joins basket 88 with one of cables 26 so the latter may serve as a guide during vertical movement of the basket. A rigid three-piece framework 92 mounts sheaves 94 over which line 38 from trailer 16 is trained. This line is coupled with the basket to support the latter and raise and lower it. A door 96 provides access to the interior of basket 88. A flat plate 98 which is slidably received by line 38 fits into opening 90 to close the opening when the basket is lowered beneath the floor of the gondola. It is also to be noted that loud speakers 100 (FIG. 6) and floodlights 102 are mounted along the outside of framework 66. A control panel 104 (FIG. 3) inside of the gondola includes controls for operating winches 86 to control the balloon height and also winches 24 for maintaining the balloon level.

As previously indicated, the equipment of the present invention is particularly designed for use in high rise buildings such as the structure 104 indicated at the righthand side of FIG. 5. All of the equipment 10 is normally stored on trailer 16 for quick transport to the building where it is needed. Balloon 12 is, of course, deflated and would normally be stored in enclosure 48 where it can be quickly removed and readied for fire fighting and rescue work. The balloon is filled with a gas so as to make it lighter than air and provide adequate lifting capability. Helium is normally the preferred inflating gas and adequate helium is carried in suitable storage tanks on trailer 16 for this purpose. The multiple compartment balloon is designed so that some of the compartments may support a significant load in the gondola even though other compartments may become punctured or damaged. Even if all of the compartments except the innermost one 58A become deflated, this compartment will provide sufficient lifting force so as to prevent any dangerous crash of the equipment. Although not shown in the drawing, it is to be understood that in some instances it may be desirable to include a helium line extending from trailer 16 to the balloon 12 so as to provide for replacement of any helium lost as a result of inherent leakage from the balloon. Adequate monitoring equipment to provide for continual observation of the quantity of helium in the balloon may also be included. As the balloon is inflated and begins to lift off of pads 34, winches 24 are actuated so as to control upward movement of the balloon and gondola 14. Once the gondola reaches a desired working height, winches 86 are actuated to allow balloon 12 to continue moving upwardly away from the gondola. This moves the balloon out of the area of the fire and substantially reduces the possibility of the balloon becoming damaged by the fire. By increasing the distance between the balloon and the gondola, the maneuverability of the gondola is also enhanced. Water gun 80 may be actuated at any time to direct a stream of water onto a blaze in building 104. In some instances, it may be desirable to direct grappling hook 84 in the direction of a building window where the hook can catch on the window frame or casing and gun 82 then reversed so as to effect lateral movement of the gondola and bring it close to the building. If people are in the building and need to be rescued, gangplank 74 is lowered to permit people to walk directly to gondola 14. As people are brought into the gondola, they are immediately transferred to baskets 88 and winches 36 are actuated to lower people to the ground. Replacement fire fighters or equipment can be transported back to the gondola via baskets 88 from the ground. Although not shown, it is to be understood that in many cases it will be desirable to have a supply of oxygen within the gondola so as to aid victims who may have become overcome with smoke.

A battalion captain will normally be seated in chair 52 to continually monitor and operate control panel 54. This panel will include temperature gauges for balloon 12, helium level indicators within the balloon, wind speed sensors and any other instrumentation needed to monitor the balloon. This individual will also have an integrated control stick to coordinate movement of all four winches 24 which anchor and stabilize gondola 14. This will assure that the gondola will remain in its desired position adjacent the building.

When use of the equipment is completed, winches 24 are actuated to lower the balloon and gondola and as trailer 16 is approached, tether line 32 is connected with rope 30 so as to permit hand winch 28 to be utilized for the final positioning of the gondola on pads 34. Balloon 12 is deflated and it may be desirable to incorporate appropriate piping and pumps so that the helium from the balloons may be returned to the storage tanks within trailer 16.

From the foregoing, it will be appreciated that a substantially improved fire fighting and rescue device is provided meeting all of the objects of the invention heretofore set forth.

I claim:

1. A fire fighting and rescue unit for use in conjunction with high rise buildings, said unit comprising:

trailer means for transporting equipment over the road;

a balloon having a capacity for lifting objects from the ground, said balloon comprising a plurality of inflatable compartments disposed one in side of the other, each of said compartments being independent of the other, said compartments having a capacity for a quantity of gas such that if some of said compartments are deflated the remaining inflated compartments will continue to carry said load;

a gondola for transporting people and equipment to and from an elevated location;

means coupling said balloon with said gondola for raising and lowering the balloon relative to the gondola;

means coupled with said gondola and operable from said trailer for raising and lowering people and equipment to and from said gondola when the latter is in an elevated location; and means for coupling said gondola with said trailer while said gondola is raised to a working level by said balloon.

2. The invention of claim 1, wherein said means for raising and lowering people and equipment comprises an enclosed basket, cable means coupled with said basket, and winch means coupled with said cable means.

3. The invention of claim 1, wherein is included water delivery means mounted on said gondola and conduit means coupled with said water delivery means and with a source of water.

4. The invention of claim 1, wherein is included power operated harpoon means mounted on said gondola.

5. The invention of claim 1, wherein is included collar means disposed at the base of said compartments for maintaining said compartments in predetermined spatial relationship.

6. The invention of claim 5, wherein is included at least five of said compartments.

* * * * *